US006998831B2

(12) United States Patent
Charlon

(10) Patent No.: US 6,998,831 B2
(45) **Date of Patent: *Feb. 14, 2006**

(54) HIGH OUTPUT IMPEDANCE CURRENT MIRROR WITH SUPERIOR OUTPUT VOLTAGE COMPLIANCE

(75) Inventor: Olivier Charlon, Sunnyvale, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/923,275

(22) Filed: Aug. 20, 2004

(65) Prior Publication Data

US 2005/0017705 A1 Jan. 27, 2005

Related U.S. Application Data

(63) Continuation of application No. 10/237,914, filed on Sep. 9, 2002, now Pat. No. 6,798,182.

(51) Int. Cl.
*G05F 3/16* (2006.01)

(52) U.S. Cl. ..... 323/316

(58) Field of Classification Search ..... 323/311, 323/312, 315, 316; 327/538
See application file for complete search history.

(56) References Cited

U.S. PATENT DOCUMENTS

| | | | | |
|---|---|---|---|---|
| 5,612,614 | A | 3/1997 | Barrett, Jr. et al. | |
| 5,936,393 | A * | 8/1999 | Nauta | 323/316 |
| 5,973,490 | A * | 10/1999 | Nauta | 323/316 |
| 6,570,436 | B1 * | 5/2003 | Kronmueller et al. | 327/538 |
| 6,633,198 | B2 * | 10/2003 | Spalding, Jr. | 327/538 |
| 6,798,182 | B2 * | 9/2004 | Charlon | 323/316 |

FOREIGN PATENT DOCUMENTS

DE EP 0356570 A1 9/1988

* cited by examiner

*Primary Examiner*—Gary L Laxton
(74) *Attorney, Agent, or Firm*—Aaron Waxler

(57) ABSTRACT

A current mirror divides an input source voltage dynamically, to provide a controlled voltage that corresponds to an output load voltage. The correspondence between this controlled voltage and the output load voltage determines the correspondence between the output current and the input current. By dynamically adjusting the controlled voltage, the correspondence to the output load voltage can be maintained to very low voltage. Preferably, the output load voltage is also dynamically divided to provide a comparison voltage for comparing to the controlled voltage when the output load voltage is high, thereby providing the appropriate output current at high voltage levels. The combination of these two techniques provides a wide output voltage compliance, and a high output impedance.

6 Claims, 1 Drawing Sheet

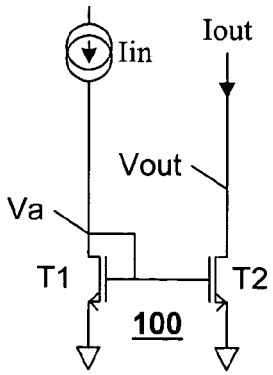
FIG. 1 [Prior Art]
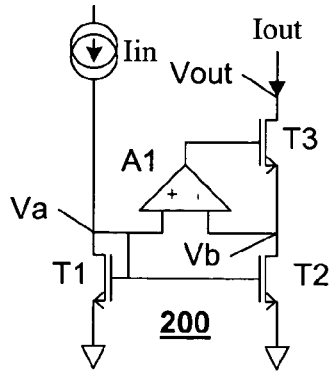
FIG. 2 [Prior Art]
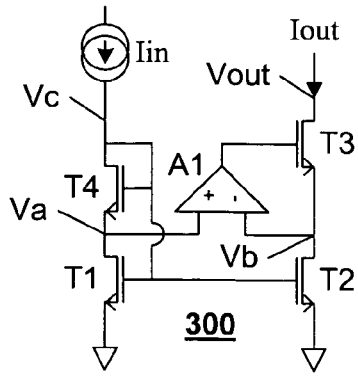
FIG. 3 [Prior Art]
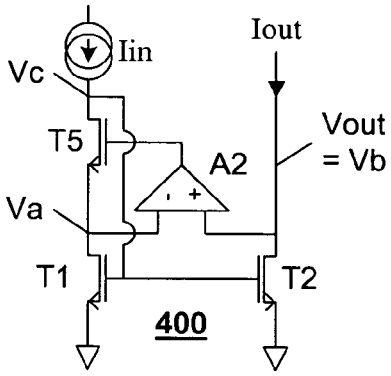
FIG. 4
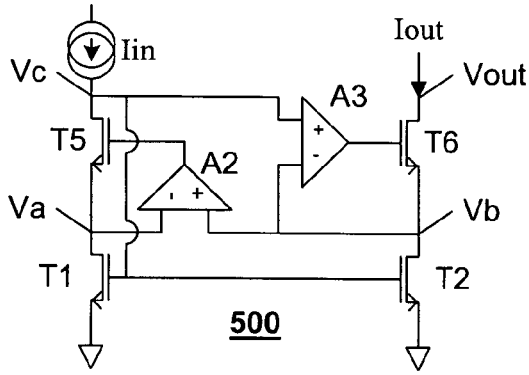
FIG. 5

HIGH OUTPUT IMPEDANCE CURRENT MIRROR WITH SUPERIOR OUTPUT VOLTAGE COMPLIANCE

This is a Continuation of application Ser. No. 10/237,914, filed Sep. 9, 2002 now U.S. Pat. No. 6,798,182.

BACKGROUND OF THE INVENTION

1. Field of the Invention

This invention relates to the field of electronic circuit design, and in particular to the design of a current mirror that provides a high output impedance and an accurate mirror of input current across a wide range of output voltages.

2. Description of Related Art

Current mirrors are often used to provide a controlled current to a component without loading the source of the controlled current. An independent source generates a current at a given value; the current mirror provides an output current to a load, such that the output current corresponds to the value of the independently generated current. In this manner, the source of the desired current is isolated from the load that receives an equivalent current.

FIG. 1 illustrates an example circuit diagram of a basic current mirror 100. A transistor T1 is configured as a diode, by connecting its drain and gate, for communicating the independent source current, Iin, to ground. A second transistor T2 has its gate connected to the gate of T1, and has its source connected to the same potential as the source of T1. Thus, the gate-to-source voltages of each of the transistors T1 and T2 are equal, and, if the transistors T1 and T2 are operationally identical, the drain-to-source current through each will be the same. The current through T1 corresponds to the input current Iin; therefore, assuming that the source of the current Iout is sufficient to provide at least this value of current, the output current, Iout, will be equal to Iin. Note, however, that the characteristics of the load that is intended to draw the current Iout can affect the operation of transistor T2, by affecting transistor T2's drain-to-source voltage, Vout. If the drain-to-source voltage Vout of transistor T2 does not equal the drain-to-source voltage Va of transistor T1, the current Iout through transistor T2 will differ from the current Iin through transistor T1. If Vout is less than Va, then Iout will be less than Iin. Similarly, if Vout is greater than Va, then Iout will be greater than Iin. This is due to the limited output impedance of transistor T2.

Output voltage compliance is defined herein as the range of output voltages through which a current mirror will provide an output current Iout that corresponds to the input current Iin. The current mirror 100 exhibits relatively poor output voltage compliance, because only when Vout is equal to Va will the output current Iout equal the input current Iin, due in part to the limited output impedance of the transistor T2.

FIG. 2 illustrates an example circuit diagram of a current mirror 200 that provides greater output impedance, and thus a wider range of output voltage compliance than the current mirror 100 of FIG. 1. In the current mirror 200, a differential amplifier Al and transistor T3 are configured to assure that the drain to source voltages Va, Vb of the input T1 and output T2 transistors are equal. The amplifier A1 and transistor T3 control the drain-to-source impedance of transistor T3, such that a controlled output current Iout (=Iin) is provided independent of the output voltage Vout, when Vout is greater than Vb. Because the gate-to-source voltage and the drain-to-source voltage of each of the transistors T1 and T2 are assured to be equal, the output current Iout is assured to be equal to the input current Iin, when the voltage Vout is greater than Vb. In the current mirror 200, the output impedance and voltage compliance is improved, compared to the current mirror 100, because in current mirror 200, the output current Iout will equal the input current Iin whenever Vout is greater than Vb, which is set equal to Va. In this case, the voltage compliance is limited to the lower value of Va, which is generally determined by the source of the input current Iin.

FIG. 3 illustrates an example circuit diagram of a current mirror 300 that is operable to lower ranges of output voltages than the current mirror 200, as taught by U.S. Pat. No. 5,612,614, issued 18 Mar. 1997 to Barrett et al., and included by reference herein. In current mirror 300, transistors T1 and T4 are configured having a common channel and two gates, thereby forming a composite transistor. This composite transistor T1–T4 is diode-connected, by coupling the gates of each transistor T1, T4, to the drain of T4, thereby forming a two-input diode device that has an intermediate node between the gates that provides the drain voltage Va of transistor T1. By dividing the input source voltage Vc between the transistors T1 and T4, the voltage Va at the drain of transistor T1 is lower than the input source voltage Vc. The relative sizes/transconductances of transistors T1 and T4 determine the value of Va relative to Vc. Because the diode arrangement requires that the transconductance of transistor T4 be substantially higher than the transconductance of transistor T1, the value of Va relative to Vc is limited.

BRIEF SUMMARY OF THE INVENTION

It is an object of this invention to provide a current mirror having a large output voltage compliance. It is a further object of this invention to provide a current mirror that dynamically adjusts for differences between an input source voltage and an output load voltage, so as to provide a large output voltage compliance.

These objects and others are achieved by providing a current mirror that divides an input source voltage dynamically, to provide a controlled voltage that corresponds to an output load voltage. The correspondence between this controlled voltage and the output load voltage determines the correspondence between the output current and the input current. By dynamically adjusting the controlled voltage, the correspondence to the output load voltage can be maintained to very low voltage levels. Preferably, the output load voltage is also dynamically divided to provide a comparison voltage for comparing to the controlled voltage when the output load voltage is high, thereby providing the appropriate output current at high voltage levels.

BRIEF DESCRIPTION OF THE DRAWINGS

The invention is explained in further detail, and by way of example, with reference to the accompanying drawings wherein:

FIG. 1 illustrates an example circuit diagram of a basic current mirror.

FIG. 2 illustrates an example circuit diagram of a current mirror that is configured to exhibit higher output impedance and voltage compliance than the basic current mirror of FIG. 1.

FIG. 3 illustrates an example circuit diagram of a current mirror that is operable to lower voltage levels than the current mirrors of FIGS. 1 and 2, and exhibits a large output impedance.

FIG. 4 illustrates an example circuit diagram of a current mirror in accordance with a first aspect of this invention.

FIG. 5 illustrates an example circuit diagram of a current mirror in accordance with a second aspect of this invention.

Throughout the drawings, the same reference numerals indicate similar or corresponding features or functions.

DETAILED DESCRIPTION OF THE INVENTION

FIG. 4 illustrates an example circuit diagram of a current mirror 400 in accordance with a first aspect of this invention. The current mirror 400 includes the conventional transistor pair T1, T2 having a common gate potential and common source potential. As discussed above, equal current will flow through transistors T1 and T2, provided that their respective drain-to-source voltages Va, Vb are equal.

A differential amplifier A2 and transistor T5 are configured to assure that the drain-to-source voltages Va, Vb of transistors T1, T2, are equal. As contrast to the conventional current mirrors 200, 300 of FIGS. 2 and 3, however, the amplifier A2 and transistor T5 are configured to adjust the drain-to-source voltage Va on the input transistor T1 to match the output voltage Vb, whereas current mirrors 200, 300 adjust the drain-to-source voltage Vb on the output transistor T2 to match the input source voltage Va.

As illustrated, the transistor T5 is connected in series with the input transistor T1. The conductance of the transistor T5 is determined by the amplifier A2. Transistors T5–T1 form a voltage divider of the input source voltage Vc. If the voltage at Va is larger than Vb, the conductance of transistor T5 is decreased, thereby introducing a larger drain-to-source voltage drop across T5 and a corresponding decrease in the voltage Va. In like manner, if the voltage at Va is smaller than Vb, the conductance of T5 is increased, reducing the voltage drop across T5, and thereby increasing the voltage Va. That is, the drain-to-source conductance of T5 is adjusted to assure that the input voltage Va corresponds to the output voltage Vb.

The current mirror 400 of FIG. 4 is able to track to very low output voltage levels, and to levels substantially as high as Vc. In accordance with a second aspect of this invention, FIG. 5 illustrates a current mirror 500 that is configured to track to output voltage levels above Vc.

In current mirror 500, a second differential amplifier A3 is configured to control a transistor T6, based on a comparison of voltages Vc and Vb. If Vout is much less than Vc, Vb must likewise be much less than Vc, and the amplifier A3 drives the transistor T6 to an "on" state, effectively coupling Vb directly to Vout. In this state, with Vout=Vb, the operation of mirror 500 substantially corresponds to the operation of the mirror 400, detailed above.

As Vout increases, and Vb approaches Vc, however, the amplifier A3 limits the conductance of transistor T6, thereby introducing a voltage drop across transistor T6, reducing the voltage Vb to a voltage less than Vout. As the output load voltage Vout continues to increase, beyond Vc, Vb attempts to increase with Vout, but the amplifier A3 limits the conductance of transistor T6 further, thereby keeping Vb equal to Vc. In this manner, Vb is maintained equal to Vc, Va is controlled by amplifier A2 to match Vc, and therefore the current Iout through transistor T2 is maintained equal to the current Iin through transistor T1.

Thus, the current mirror 500 provides tracking to both very low levels of Vout and to very high levels of Vout, by operating the transistor T6 as a closed switch for low-level tracking, and as a variable conductance device, for high-level tracking.

The foregoing merely illustrates the principles of the invention. It will thus be appreciated that those skilled in the art will be able to devise various arrangements which, although not explicitly described or shown herein, embody the principles of the invention and are thus within its spirit and scope. For example, NMOS transistors are illustrated in each of the figures, although the principles presented in this disclosure are applicable to other transistor types, including bipolar, PMOS, BiCMOS, and so on. Replacing transistors T5 or T6 with PMOS devices, for example, merely requires a change of the sense of the corresponding amplifiers A2 and A3. In like manner, the figures illustrate a fairly primitive form of current mirrors comprising a single input stage and output stage, for ease of understanding. One of ordinary skill in the art will recognize that existing techniques for improving the performance of a current mirror, or providing additional capabilities, can be included in the mirrors 400, 500 while still realizing the wide range of voltage compliance that these mirrors provide. For example, each of the mirrors 400, 500 may be configured as variable-current-gain devices, as compared to the 1:1 mirror gain illustrated, or configured to provide improved noise immunity, or improved temperature independence, and so on. These and other system configuration and optimization features will be evident to one of ordinary skill in the art in view of this disclosure, and are included within the scope of the following claims.

I claim:

1. A current mirror that receives an input current, and provides an output current corresponding to the input current, comprising:

an input stage that is configured to receive the input current at an input voltage, and an output stage that is configured to provide the output current at an output voltage, wherein the input stage includes:

a first voltage divider network that is configured to receive the input voltage and to provide therefrom a controlled voltage based on a first control signal, and a first control device that is configured to receive a controlling voltage that is based on the output voltage, and to provide therefrom the first control signal to the first voltage divider network to control the controlled voltage to correspond to the controlling voltage; wherein the first voltage divider network includes:

a first transistor and a second transistor;

wherein:

the first transistor and second transistor each include a gate, a drain, and a source, and the gate of the first transistor receives the first control signal, the drain of the first transistor receives the input current at the input voltage, the source of the first transistor is coupled to the drain of the second transistor, the gate of the second transistor is coupled to the drain of the first transistor, the source of the second transistor is coupled to a reference voltage, and the controlled voltage is provided at the drain of the second transistor, and wherein a second control device is provided to control said output current as a function of said input voltage.

2. The current mirror of claim 1, wherein the output stage includes a third transistor having a gate, a source, and a drain, the gate of the third transistor is coupled to the gate of the second transistor, the source of the third transistor is coupled to the reference voltage, and the drain of the third transistor provides the controlling voltage that is based on the output voltage, and the first control device is configured to:

compare the controlled voltage at the drain of the second transistor with the controlling voltage at the drain of the third transistor, and provide therefrom the first control signal at the gate of the first transistor.

3. The current mirror of claim 2, wherein the output stage includes:

a fourth transistor having a gate, a drain, and a source, the drain of the fourth transistor providing the output current, and the source of the fourth transistor being coupled to the drain of the third transistor; and said second control device that is configured to control the gate of the fourth transistor, based on a comparison of the controlling voltage at the drain of the third transistor and the input voltage.

4. A method controlling an output current based on an input current, comprising:

determining a controlling voltage, based on an output voltage associated with the output current, and controlling an input stage to provide a controlled voltage from an input voltage associated with the input current, based on the controlling voltage, wherein correspondence between the controlled voltage and the controlling voltage provides correspondence between the output current and the input current, controlling the input stage includes controlling conductance of a first device in a first series network that receives the input current, the controlled voltage corresponds to a voltage division of the input voltage, based on the conductance of the first device, and providing a control device to control said output current as a function of said input voltage.

5. The method of claim 4, wherein controlling the conductance of the first device includes:

determining a difference between the controlled voltage and the controlling voltage, and adjusting the conductance of the first device to reduce the difference.

6. The method of claim 5, wherein determining the controlling voltage includes:

controlling an output stage to provide the controlling voltage based on the controlling voltage and the input voltage.

* * * * *